United States Patent [19]

Schinzinger et al.

[11] Patent Number: 4,996,851

[45] Date of Patent: Mar. 5, 1991

[54] EARRING FINDING

[76] Inventors: Stefan Schinzinger; Sally Kellman, both of 651 Addison St. - A, Berkeley, Calif. 94701

[21] Appl. No.: 494,468

[22] Filed: Mar. 16, 1990

[51] Int. Cl.[5] ..... A44C 7/00

[52] U.S. Cl. ..... 63/26; 63/12

[58] Field of Search ..... 63/26, 27, 28, 12, DIG. 1, 63/29.1, 32, 2

[56] References Cited

U.S. PATENT DOCUMENTS

| | | | |
|---|---|---|---|
| 1,754,964 | 4/1930 | Paucoast | 63/26 X |
| 2,596,965 | 5/1952 | Troy | 63/26 X |
| 3,430,829 | 3/1969 | Wilson et al. | 63/29.1 X |
| 3,732,134 | 5/1973 | Michael | 63/26 X |
| 4,220,016 | 9/1980 | Frenger | 63/DIG. 1 |
| 4,935,268 | 6/1990 | Pöll | 63/26 X |
| 4,936,116 | 6/1990 | Pöll | 63/26 X |

*Primary Examiner*—James R. Brittain

*Attorney, Agent, or Firm*—Glen R. Grunewald

[57] ABSTRACT

An earring finding including a circular disc to which a polygonal pad is adhesively connected, the side of the polygonal pad that is not connected to the disc having a layer of adhesive covered with a stripable membrane.

7 Claims, 2 Drawing Sheets

EARRING FINDING

TECHNICAL FIELD

This invention is in the field of findings, particularly findings that are useful in the manufacture of earrings.

BACKGROUND ART

An earring finding is the piece between the attachment to the user's ear and the decorative part of an earring. A pierced ear earring finding may comprise a loop of wire or a post, either of which passes through the hole in the user's earlobe. An unpierced earring finding usually comprises a screw clamp or a spring clamp which grasps the user's earlobe. Virtually all earrings are manufactured by attaching the decorative portion of the earring to a finding.

In manufacturing inexpensive earrings it is important that neither great effort nor expensive materials be used to attach the decorative part to the finding. It is known to use adhesive for this purpose.

One successful technique that is known is to use a finding that includes a circular metal disc connected to the post, clamp or other attachment to the user's ear and to mount the decorative part of the earring to the metal disc with adhesive. A particularly useful version of this technique employs a circular pad having adhesive on both sides but having the adhesive covered with a strippable membrane. The decorative part of an earring can then be mounted to a finding by first stripping the membrane from one side of the pad and adhesively fixing the pad to the finding disc and then stripping the membrane from the other side of the pad and adhesively fixing the decorative part of the earring to that side.

A problem with this technique is that it is difficult and time consuming for an assembler to place an adhesive covered circular pad on a circular disc so that the circumferences of the pad and the disc coincide. It is also very difficult and time consuming, and sometimes even impossible, to adjust the position of a pad that is inaccurately mounted on a disc with the circumferences of the pad and the disc out of register. When the pad and disc circumferences do not coincide the decorative part of the earring may not be mounted securely in its desired position and the portions of the disc and pad that are out of register expose adhesive which may stick to a user's hair or cause an allergic reaction by coming in contact with a user's skin.

DISCLOSURE OF THE INVENTION

This invention is an earring finding that solves or greatly mitigates the problems noted above. This invention is an earring finding that includes any known attachment to a user's ear, which attachment is fixed to a circular disc by such means as welding, braising or interlocking with punched or drilled holes. The circular disc is of suitable size and suitably located to receive the decorative part of the earring. The circular disc of the finding of this invention is adhesively attached to a pad of an elastomer, preferably a pad of foam elastomer, the pad being of polygonal shape. The side of a pad that is not attached to the disc is provided with a layer of adhesive that is covered with a strippable membrane which can be removed to expose the adhesive layer. The maximum distance between points distinguished by intersections of the sides of the polygonal pad is the diameter of the disc and all points should lie on a common circular circumference.

The pad may be mounted on a circular disc with no portion of the pad extending beyond the circumference of the disc as explained below.

There are two major advantages to the finding of this invention. The first major advantage is that it is easy to assemble an adhesive covered, polygonal pad onto a circular disc in proper register with the circumference of the disc. Although pads of many shapes may be used, a regular hexagonal polygonal pad will be used to illustrate the invention. When the distance between opposite points of the hexagonal pad is the diameter of the disc, then the adhesive covered pad can be assembled on the disc by placing two adjacent points at the circumference of the disc and then rolling the pad across the disc or rolling the disc across the pad so that the entire adhesive covered surface of the pad contacts the surface of the disc. If any two points of the hexagon-shaped pad are at the circumference of the disc, all other points will be correctly oriented when the entire hexagon is brought into contact with the disc. In other words, it is not necessary, as with a circular pad, to have a substantial length of arc of the pad coincide with a corresponding length of arc of the circumference of a disc in order for the circumferences of the circular disc and the circular pad to become oriented to register with one another. The initial positioning of the pad on the disc in the process of assembling the device of this invention can be made with only a thin line of the pad's adhesive contacting the disc. Small adjustments in the orientation of the pad can be made before the entire surface of the pad is brought into adhesive contact with the disc.

Although pads in any polygonal shape may be used in accordance with this invention, pads that are hexagonal or square are preferred not only because of their ease of assembly but also because sheets of pad material can be made into squares and hexagons with no waste, as will be discussed below.

The term polygonal shape is used in this specification to include shapes that have the general character of polygons. The term includes shapes that would be squares or hexagons except for having curved sides. The term also includes shapes such as stars. The polygonal shapes useful in this invention are those where all of the points formed by intersecting sides lie on a common circular circumference.

Sheets of pad material may be precut with small pads of appropriate size and shape to make findings in accordance with this invention. This sheet material is in the form of foam elastomer covered on both sides with a layer of adhesive and with both adhesive layers covered with a strippable membrane. Thus, the sheets of pad material have a top layer of strippable membrane, a next lower layer of adhesive, a next lower layer of foam elastomer, a next lower layer of adhesive and a bottom layer of strippable membrane. Sheets of this character can be cut by a process known as "kiss cutting" wherein the cutting blades sever all layers except the bottom layer of strippable membrane. Such sheets, when cut into hexagonal pieces for example, can be used to assemble earrings.

The person assembling an earring from precut sheet material will remove the strippable membrane from one hexagonal cut member and mount a finding on it by registering two of the six hexagon points adjacent the circumference of the circular disc of the finding and rolling the circular disc into full contact with the exposed adhesive of the hexagon shaped pad. This procedure may be repeated with any number of findings. When assembling and earring the finding is lifted from the sheet of material whereby the pad material is freed from the lower strippable membrane and its bottom layer of adhesive exposed. The exposed adhesive may then be pressed into contact with the decorative portion of the earring to fix it to the finding.

DETAILED DESCRIPTION OF A PREFERRED EMBODIMENT

Figure 1:
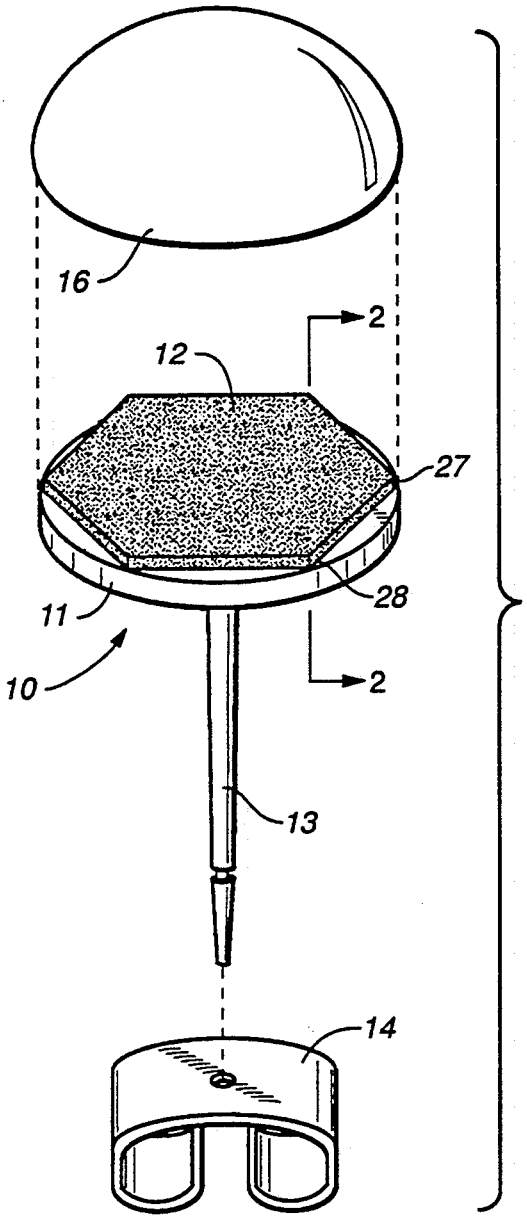
FIG. 1 is a perspective view of a finding embodying this invention showing in exploded form a locking element and a decorative element.
Figure 3:
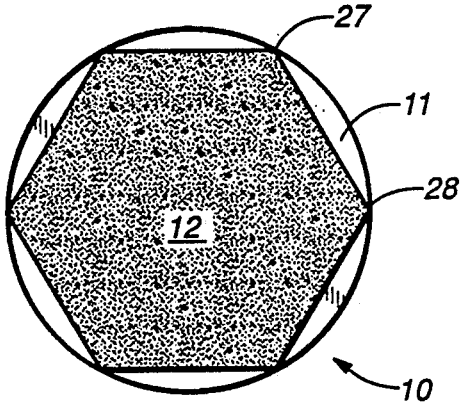
FIG. 3 is a top plan view of the finding illustrated in FIG. 1.

FIGS. 1 and 3 illustrate a preferred embodiment of the invention wherein a finding generally designated 10 includes a circular disc 11 adhesively fixed to a polygonal elastomer pad 12 which is in the shape of a regular hexagon. The disc 11 has affixed to it on the other side a post 13 which is one of the known means for holding an earring to a user's ear. The post 13 is passed through the hole in a user's earlobe and a clamping means 14 grasps the side of the post extending through the hole in the user's ear lobe. A decorative element 16 is also illustrated in FIG. 1.

Figure 2:
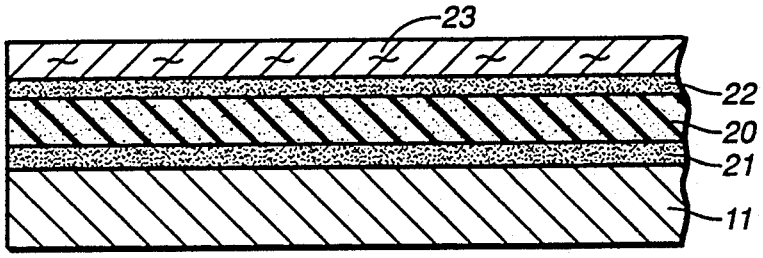
FIG. 2 is a partial cross section taken along the plane of the line 2—2 of FIG. 1.

The enlarged cross-section shown in FIG. 2 illustrates that the disc 11 is held to the elastomer pad 12 with a layer of adhesive 21. The elastomer pad has another layer of adhesive 22 which is protected with a strippable membrane 23.

Figure 4:
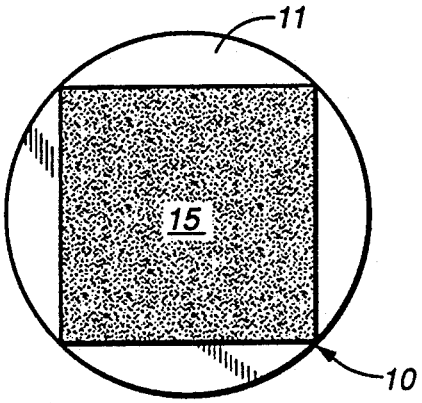
FIG. 4 is a top plan view of a finding illustrating a different embodiment of this invention.

FIG. 4 illustrates another embodiment of the invention in which a polygonal pad 15 in the shape of a square is employed. Any shape polygonal pad may be used as long as the various points formed by the intersections of its sides all lie on the circumference of a circle.

Figure 5:
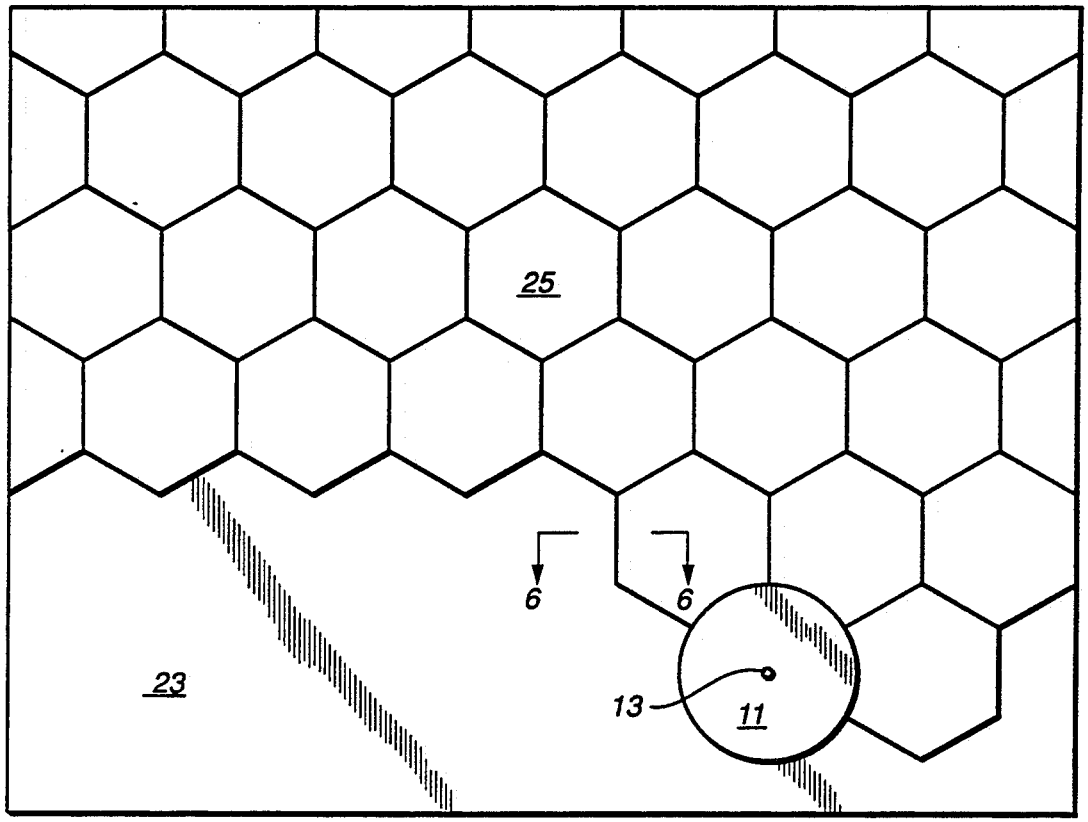
FIG. 5 is a plan view of a kiss-cut and partly used sheet of pad material for assembling devices embodying this invention.

FIG. 5 illustrates a sheet of material of indefinite size that is precut by a method known as kiss cutting to have individual hexagonal pads cut from it.

Figure 6:
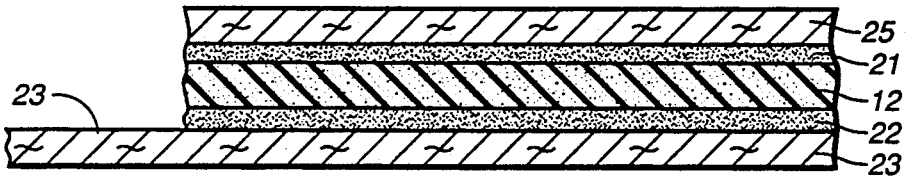
FIG. 6 is an enlarged cross section taken along the plane of the line 6—6 of FIG. 5.

FIG. 6 illustrates a cross-section taken along the plane of line 6—6 of FIG. 5 and it illustrates that the elastomeric material may have a protective, strippable membrane 25 on top of it as well as a protective strippable membrane 23 on its bottom. Because the kiss cutting method severs membrane 25, adhesive layer 21, foam elastomer 12 and adhesive layer 22 but not strippable membrane 25, a sheet with an indefinite number of hexagonal pads may be provided while still having the character of an integral sheet material. A particularly desirable method for using such sheet material is to remove the strippable membrane from only one hexagonal pad and to apply the disc 11 to that single pad, as shown in FIG. 5, and then to lift the disc 11 from the sheet whereby only the hexagonal pad beneath the disc 11 is removed from the sheet while all other hexagonal pads 12 remain on the sheet.

A pad can be almost perfectly oriented with regard to disc 11 if the strippable membrane 25 is first removed from the hexagonal element pad and if any two adjacent points, for example points 27 and 28 illustrated in FIGS. 1 and 3, are placed exactly on the circumference of disc 11 after which disc 11 may be rolled into full contact with the remaining surface of hexagonal pad 12 whereupon all points on the pad will be oriented adjacent to the circumference and no portion of hexagonal pad 12 will extend beyond the periphery of disc 11. Disc 11 can then be lifted from the sheet and foam pad 22 will be released from membrane 23. A decorative element can then be placed on the exposed adhesive 22 to complete the assembly process of an earring.

We claim:

1. A finding comprising:

a circular disc having first and second faces, attaching means fixed to said first face, a polygonal elastomer pad having firsts and second polygonal sides, said first side of which is adhesively fixed to said second face and positioned with the points formed by intersections between adjacent edges of said polygonal pad lying on the circumference of the said disc, a layer of adhesive on the second side of said polygonal pad, and a stripable membrane covering said layer of adhesive.

2. The finding of claim 1 wherein said disc is metal.

3. The finding of claim 1 wherein said attaching means is a post.

4. The finding of claim 1 wherein said elastomer pad is foam.

5. The finding of claim 1 wherein said elastomer pad is in the shape of a regular hexagon.

6. The finding of claim 1 wherein said elastomer pad is in the shape of a square.

7. The finding of claim 1 wherein the maximum distance between said points is the diameter of said disc.

* * * * *